US011397401B1

(12) United States Patent
Yamagishi

(10) Patent No.: US 11,397,401 B1
(45) Date of Patent: Jul. 26, 2022

(54) IMAGE FORMING APPARATUS

(71) Applicant: FUJIFILM Business Innovation Corp., Tokyo (JP)

(72) Inventor: Kazunari Yamagishi, Kanagawa (JP)

(73) Assignee: FUJIFILM Business Innovation Corp., Tokyo (JP)

( * ) Notice: Subject to any disclaimer, the term of this patent is extended or adjusted under 35 U.S.C. 154(b) by 0 days.

(21) Appl. No.: 17/492,669

(22) Filed: Oct. 3, 2021

(30) Foreign Application Priority Data

May 25, 2021 (JP) ..... JP2021-087570

(51) Int. Cl.
*G03G 21/06* (2006.01)
*G03G 15/16* (2006.01)

(52) U.S. Cl.
CPC ..... *G03G 21/06* (2013.01); *G03G 15/1675* (2013.01)

(58) Field of Classification Search
CPC ..... G03G 15/1675; G03G 15/0131; G03G 15/161; G03G 15/80; G03G 15/1685; G03G 2215/1661; G03G 21/06
See application file for complete search history.

(56) References Cited

U.S. PATENT DOCUMENTS

2013/0315626 A1* 11/2013 Nakai ..... G03G 21/06 399/128
2014/0079419 A1* 3/2014 Itani ..... G03G 15/0266 399/128
2014/0334836 A1* 11/2014 Yoshiyama ..... G03G 15/065 399/346
2018/0321610 A1* 11/2018 Tsujimoto ..... G03G 15/0266

FOREIGN PATENT DOCUMENTS

JP 2013228491 11/2013
JP 2016206597 12/2016

* cited by examiner

*Primary Examiner* — Jessica L Eley
(74) *Attorney, Agent, or Firm* — JCIPRNET

(57) ABSTRACT

An image forming apparatus includes: an image holding section that includes a photoconductor having a surface protection layer; a charging section that charges a surface of the image holding section with a direct current potential; an exposure section that exposes the surface of the image holding section charged by the charging section to form an electrostatic latent image; a developing section that develops the electrostatic latent image formed on the image holding section; a transfer section that electrostatically transfers a visible image formed on the image holding section to a transfer medium; an exposure static elimination section that eliminates a residual charge of the image holding section by using the exposure section when image formation on the image holding section is stopped; a transfer static elimination section that eliminates the residual charge of the image holding section by using at least the transfer section when the image formation on the image holding section is stopped; and a switching section that causes the exposure static elimination section to perform static elimination under a condition that the residual charge of the image holding section does not exceed a threshold value of an allowable static elimination level at which the residual charge is eliminated by the exposure static elimination section, and causes the transfer static elimination section instead of the exposure static elimination section to perform static elimination under a condition that the residual charge exceeds the threshold value.

20 Claims, 10 Drawing Sheets

IMAGE FORMING APPARATUS

CROSS-REFERENCE TO RELATED APPLICATIONS

This application is based on and claims priority under 35 USC 119 from Japanese Patent Application No. 2021-087570 filed May 25, 2021.

BACKGROUND

(i) Technical Field

The present invention relates to an image forming apparatus.

(ii) Related Art

In the related art, for example, image forming apparatuses described in JP2016-206597A, and JP2013-228491A are previously known.

In JP2016-206597A, a first mode, in which a toner is less likely to adhere to a developing sleeve and a second mode, in which wasteful toner consumption due to fog is suppressed is switched based on information that affects a toner charging amount, and static on a surface of an image carrier is eliminated, so that a potential of the image carrier is forcibly lowered. As a result, in particular, a technology of suppressing toner adhesion to the developing sleeve and suppressing the wasteful toner consumption even in a case of a direct current (DC) charging method is disclosed.

JP2013-228491A discloses a technology in which when formation of an image is stopped, a potential of an image holding body is gradually brought closer to a ground potential, by exposing a surface of the image holding body with an electrostatic latent image forming section while bringing a potential applied to a developing section close to the ground potential, and a potential of the image holding body, sequentially determined based on the amount of light when the electrostatic latent image forming section exposes the surface of the image holding body as the potential of the image holding body, is brought close to the ground potential.

SUMMARY

Aspects of non-limiting embodiments of the present disclosure relate to an image forming apparatus that performs static elimination on an image holding section consisting of a photoconductor having a surface protection layer, in which static elimination performance for a charge on a surface of the image holding section is stabilized while suppressing an influence on a life of the image holding section.

Aspects of certain non-limiting embodiments of the present disclosure address the above advantages and/or other advantages not described above. However, aspects of the non-limiting embodiments are not required to address the advantages described above, and aspects of the non-limiting embodiments of the present disclosure may not address advantages described above.

According to an aspect of the present disclosure, there is provided an image forming apparatus including: an image holding section that consists of a photoconductor having a surface protection layer; a charging section that charges a surface of the image holding section with a direct current potential; an exposure section that exposes the surface of the image holding section charged by the charging section to form an electrostatic latent image; a developing section that develops the electrostatic latent image formed on the image holding section; a transfer section that electrostatically transfers a visible image formed on the image holding section to a transfer medium; an exposure static elimination section that eliminates a residual charge of the image holding section by using the exposure section when image formation on the image holding section is stopped; a transfer static elimination section that eliminates the residual charge of the image holding section by using at least the transfer section when the image formation on the image holding section is stopped; and a switching section that causes the exposure static elimination section to perform static elimination under a condition that the residual charge of the image holding section does not exceed a threshold value of an allowable static elimination level at which the residual charge is eliminated by the exposure static elimination section, and causes the transfer static elimination section instead of the exposure static elimination section to perform static elimination under a condition that the residual charge exceeds the threshold value.

BRIEF DESCRIPTION OF THE DRAWINGS

Exemplary embodiment(s) of the present invention will be described in detail based on the following figures, wherein.

DETAILED DESCRIPTION

Outline of Exemplary Embodiment

Figure 1:
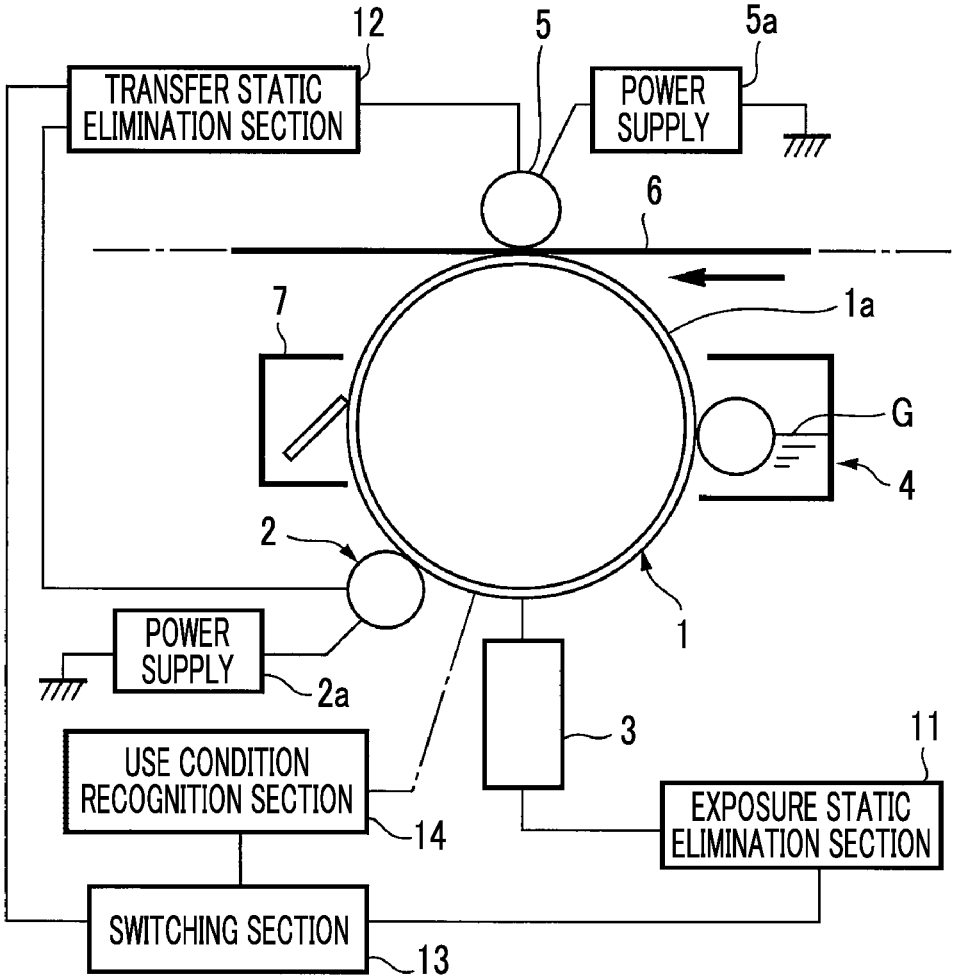
FIG. 1 is an explanatory diagram illustrating an outline of an exemplary embodiment of an image forming apparatus to which the present disclosure is applied.

FIG. 1 is an explanatory diagram illustrating an outline of an exemplary embodiment of an image forming apparatus to which the present disclosure is applied.

In FIG. 1, the image forming apparatus includes an image holding section 1 that consists of a photoconductor having a surface protection layer 1*a*, a charging section 2 that charges a surface of the image holding section 1 with a direct current potential, and an exposure section 3 that exposes the surface of the image holding section 1 charged by the charging section 2 to form an electrostatic latent image, a developing section 4 that develops the electrostatic latent image formed on the image holding section 1, a transfer section 5 that electrostatically transfers a visible image formed on the image holding section 1 to a transfer medium 6, an exposure static elimination section 11 that eliminates a residual charge of the image holding section 1 by using the exposure section 3 when image formation on the image holding section 1 is stopped, a transfer static elimination section 12 that eliminates the residual charge of the image holding section 1 by using at least the transfer section 5 when the image formation on the image holding section 1 is stopped, and a switching section 13 that causes the exposure static elimination section 11 to perform static elimination under a condition that the residual charge of the image holding section 1 does not exceed a threshold value of an allowable static elimination level at which the residual charge is eliminated by the exposure static elimination section 11, and causes the transfer static elimination section 12 instead of the exposure static elimination section 11 to perform static elimination under a condition the residual charge exceeds the threshold value.

In FIG. 1, a reference numeral 7 is a cleaning section that cleans a residue remaining on the image holding section 1, a reference numeral 2*a* is a power supply for the charging section 2, and a reference numeral 5*a* is a power supply for the transfer section 5.

In such a technical section, for the image holding section 1, an application target may be a photoconductor having the surface protection layer 1*a*, and the surface protection layer 1*a* may be a protection layer having hardness higher than hardness of the photoconductor, and of course, the photoconductor may be a separate body, or a surface of the photoconductor may be cured.

Here, in the photoconductor having the surface protection layer 1*a*, charges are accumulated in the surface protection layer 1*a* or at an interface with an electric field transport layer, as compared with an organic photoconductor without the surface protection layer 1*a*, and it becomes difficult to remove the residual charge on the surface of the photoconductor only by exposure static elimination.

Further, the charging section 2 is a target to be charged with a direct current potential. In an alternating current charging method, charging performance is high, generation of discharge products is likely to be activated on the surface of the photoconductor, and the photoconductor having the surface protection layer 1*a* has a high-abrasion resistance, and it is difficult to remove the discharge products. Therefore, the discharge product is likely to be filmed on the surface of the photoconductor. On the other hand, in the direct current charging method, the charging stress applied to the surface of the photoconductor is small, and it is possible to suppress the filming of the discharge product.

Further, as for the exposure static elimination section 11, for example, as illustrated in JP2016-206597A, stepwise exposure static elimination that changes an exposure level stepwise is effective. Meanwhile, uniform exposure static elimination that does not change the exposure level stepwise is also included.

Furthermore, the transfer static elimination section 12 may be a static elimination method using only the transfer section 5, or includes an aspect in which the transfer section 5 and the charging section 2 are combined.

Next, a representative aspect or an exemplary aspect of an image forming apparatus according to the present exemplary embodiment will be described.

First, an exemplary aspect of the developing section 4 is an aspect of developing an electrostatic latent image by using a two-component developer including a toner and a carrier as an image forming material G. For example, in the aspect in which the image holding section 1 includes the photoconductor having the surface protection layer 1*a*, a dielectric constant becomes high, a charge on the photoconductor tends to remain only by exposure static elimination by the exposure static elimination section 11, a carrier discharge becomes noticeable in addition to an excessive toner fog, and an image quality is likely to deteriorate, so that this is preferable in that a method of switching a static elimination method according to the present application works more effectively, for example.

Further, examples of a representative aspect of the exposure static elimination section 11 include an aspect of reducing a developing voltage applied to the developing section 4 to the ground potential, and executing static elimination by the exposure section 3.

In this case, for example, as for the exposure static elimination section 11, an aspect in which the amount of light of the exposure section 3 is gradually output so that a residual potential of the image holding section 1 gradually approaches the ground potential while a developing voltage applied to the developing section 4 approaches the ground potential is preferable in that static elimination efficiency is increased.

Further, examples of a representative aspect of the transfer static elimination section 12 include an aspect in which a static elimination voltage is applied to the transfer section 5 from the power supply 5*a* so that a surface potential of the image holding section 1 becomes a target potential after static elimination, and static elimination is performed on the image holding section 1.

In particular, for example, from the viewpoint of improving the static elimination efficiency, as for the transfer static elimination section 12, in order to make the surface potential of the image holding section 1 exceed the target potential after static elimination, it is preferable that after applying the static elimination voltage to the transfer section 5 from the power supply 5*a* to eliminate static from the image holding section 1, the image holding section 1 is charged so as to reach the target potential after static elimination by the power supply 2*a* of the charging section 2.

Further, examples of a representative aspect of the switching section 13 include an aspect in which the use condition recognition section 14 capable of recognizing a use condition of the image holding section 1 is provided, and static elimination is performed by the exposure static elimination section 11 or the transfer static elimination section 12 based on a recognition result by the use condition recognition section 14.

Here, the use condition of the image holding section 1 includes an environment condition, an image forming condition (concentration and image density), a use history condition (rotation speed), and the like.

Hereinafter, specific aspects of the use condition recognition section 14 will be as follows.

(1) Aspect in which the Use Condition Recognition Section 14 is an Environment Detection Section In the present example, the switching section 13 includes an environment detection section capable of detecting environment information including a temperature and humidity around the image holding section 1 as the use condition recognition section 14, and static elimination is performed by the transfer static elimination section 12 when a detection result of the environment detection section belongs to a predetermined low-temperature and low-humidity environment.

(2) Aspect in which the Use Condition Recognition Section 14 is a Concentration Detection Section In the present example, the switching section 13 includes a concentration detection section capable of detecting a concentration of a visible image formed on the image holding section 1 as the use condition recognition section 14, and static elimination is performed by the transfer static elimination section 12 when concentration information detected by the concentration detection section is lower than a predetermined reference concentration.

(3) Aspect in which the Use Condition Recognition Section 14 is an Image Discrimination Unit In the present example, the switching section 13 includes an image discrimination unit capable of discriminating an average image density of the visible image formed in the image holding section 1 as the use condition recognition section 14, and static elimination is performed by the transfer static elimination section 12 when the average image density discriminated by the image discrimination unit is lower than a predetermined reference image density in the number of continuous image formations.

(4) Aspect in which the Use Condition Recognition Section 14 is a Counting Unit In the present example, the switching section 13 includes a counting unit capable of counting a rotation speed of the image holding section 1 as the use condition recognition section 14, and static elimination is performed by the transfer static elimination section 12 when the rotation speed of the image holding section 1 counted by the counting unit is equal to or more than a predetermined reference rotation speed.

Exemplary Embodiment 1

Hereinafter, the present disclosure will be described in detail based on the exemplary embodiments illustrated in accompanying drawings.

Overall Configuration of Image Forming Apparatus

Figure 2:
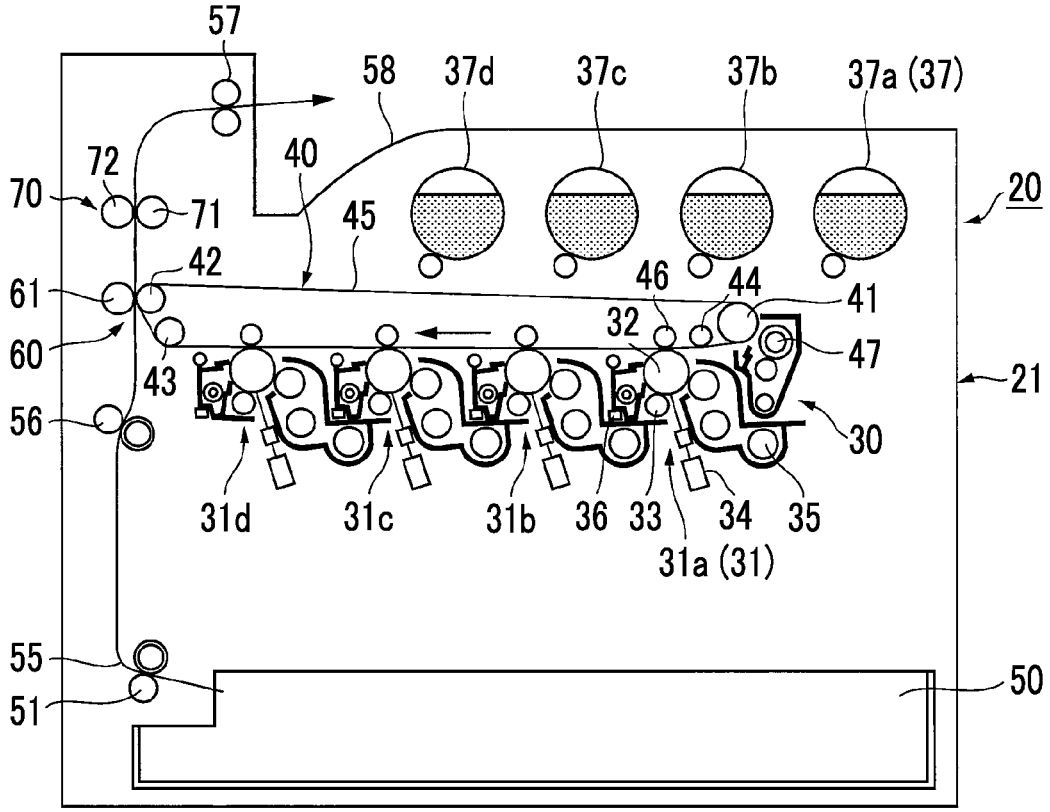
FIG. 2 is an explanatory diagram illustrating an overall configuration of an image forming apparatus according to Exemplary Embodiment 1.

FIG. 2 is an explanatory diagram illustrating an overall configuration of an image forming apparatus according to Exemplary Embodiment 1.

In FIG. 2, in an image forming apparatus 20, an image forming engine 30 that forms an image of a plurality of colors (four colors of yellow, magenta, cyan, and black in the present exemplary embodiment) is mount in an apparatus housing 21, a recording material supply apparatus 50 that accommodates recording materials such as paper is disposed below the image forming engine 30, and a recording material transporting path 55 from the recording material supply apparatus 50 is disposed in a substantially vertical direction.

In the present example, in the image forming engine 30, image forming units 31 (specifically, 31*a* to 31*d*) that forms the image of the plurality of colors are arranged in a substantially horizontal direction, a transfer module 40 including, for example, a belt-shaped intermediate transfer body 45 that circulates and moves along the arrangement direction of the image forming unit 31 is disposed above the image forming unit 31, and an image of each color formed by each of the image forming units 31 is transferred to the recording material via the transfer module 40.

Figure 3:
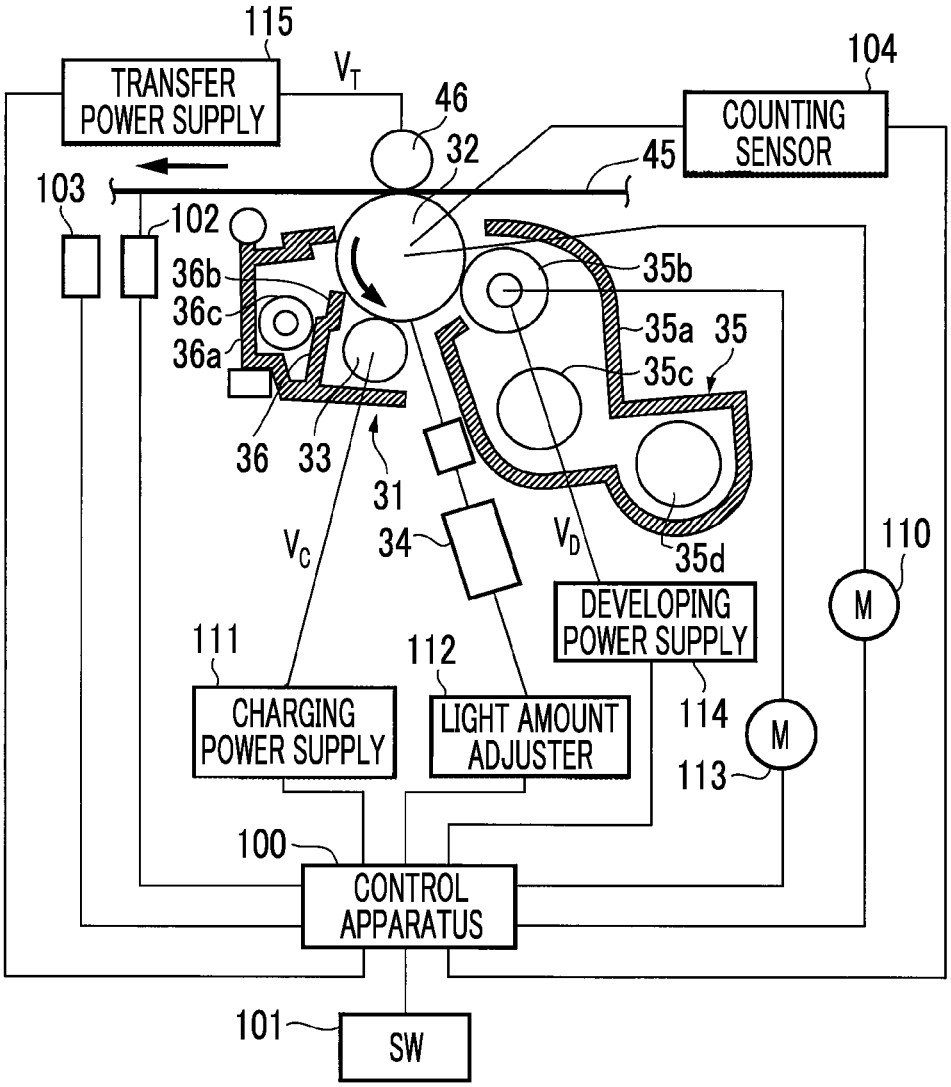
FIG. 3 is an explanatory diagram illustrating details of an image forming unit used in Exemplary Embodiment 1 and a drive control system of the image forming unit.

In the present exemplary embodiment, as illustrated in FIGS. 2 and 3, each of the image forming units 31 (31*a* to 31*d*) forms, for example, a toner image for yellow, for magenta, for cyan, and for black, in order from an upstream side in a circulation direction of the intermediate transfer body 45 (arrangement is not necessarily in this order), and includes a photoconductor 32, a charger (charging roll in this example) 33 that precharges the photoconductor 32, an exposure device (LED writing head in this example) 34 that writes an electrostatic latent image on each photoconductor 32 charged by the charger 33, a developing device 35 that develops the electrostatic latent image formed on the photoconductor 32 with a corresponding color component toner (for example, a negative electrode in the present exemplary embodiment), and a cleaner 36 that cleans a residue on the photoconductor 32.

In the present example, as illustrated in FIG. 3, the developing device 35 includes a developing container 35*a* in which a developer including a toner and a carrier is accommodated and which opens toward the photoconductor 32, a developing roll 35*b* is disposed in an opening of the developing container 35*a*, the developer held in the developing roll 35*b* is supplied to a portion facing the photoconductor 32, and agitation and transport members 35*c* and 35*d* for charging the developer, and agitating and transporting the developer are disposed in the developing container 35*a*.

Further, in the present example, the cleaner 36 includes a cleaning container 36*a* that accommodates a residue on the photoconductor 32 and opens toward the photoconductor 32, a plate-shaped cleaning member 36*b* for scraping the residue on the photoconductor 32 is attached to an opening edge of the cleaning container 36*a*, and a transport member 36*c* for transporting the accommodated residue so as to be leveled is disposed in the cleaning container 36*a*.

Reference numerals 37 (specifically, 37*a* to 37*d*) are toner cartridges that supply each color component toner to each developing device 35.

Further, in the present exemplary embodiment, the transfer module 40 includes the belt-shaped intermediate transfer body 45 spanned over a plurality of tension rolls 41 to 44, and for example, the tension roll 41 is used as a driving roll to circulate and move the intermediate transfer body 45. A transfer device (transfer roll in this example) 46 for primary transfer is disposed on a back surface of the intermediate transfer body 45 facing the photoconductor 32 of each of the image forming units 31, and by applying a transfer voltage having a polarity opposite to a charging polarity of the toner to the transfer device 46, the toner image on the photoconductor 32 is electrostatically transferred to the intermediate transfer body 45 side.

Further, a belt cleaner 47 is disposed on the upstream side of the most upstream image forming unit 31*a* of the intermediate transfer body 45 so as to remove a residual toner on the intermediate transfer body 45.

Further, in the present exemplary embodiment, a secondary transfer device 60 is disposed at a portion facing the tension roll 42 on the downstream side of the most downstream image forming unit 31*d* of the intermediate transfer body 45, and a primary transfer image on the intermediate transfer body 45 is secondarily transferred (collectively transferred) to the recording material.

In the present example, the secondary transfer device 60 includes a secondary transfer roll 61 disposed by press-contacting a toner image holding surface side of the intermediate transfer body 45, and a backup roll that is disposed on the back surface side of the intermediate transfer body 45 and forms a counter electrode of the secondary transfer roll 61 (the tension roll 42 is also used in this example). For example, the secondary transfer roll 61 is grounded, and a secondary transfer voltage having the same polarity as the charging polarity of the toner is applied to the backup roll (the tension roll 42).

Further, a supply roll 51 that supplies the recording material is provided in the recording material supply apparatus 50, a transfer roll (not illustrated) is disposed in the recording material transporting path 55, and a positioning roll (registration roll) 56 that supplies the recording material to a secondary transfer portion at a predetermined timing is disposed in the recording material transporting path 55 located immediately before the secondary transfer portion.

Further, a fixing machine 70 is provided in the recording material transporting path 55 located on the downstream side of the secondary transfer portion, and the fixing machine 70 includes, for example, a heat fixing roll 71 in which a heating heater (not illustrated) is built, and a pressure fixing roll 72 that is disposed in press-contact with the heat fixing roll 71 and rotates following the heat fixing roll 71. Further, an output roll 57 that outputs the recording material in the apparatus housing 21 is provided on the downstream side of the fixing machine 70, and the recording material is sandwiched, transported, and output, and the recording material formed on an upper portion of the apparatus housing 21 is accommodated in a recording material storage 58.

Although not illustrated in the present example, of course, a manual supply apparatus for recording material or a double-sided recording module capable of double-sided recording of the recording material may be separately provided.

Control System of Image Forming Unit

In the present exemplary embodiment, a control system of the image forming unit 31 (31*a* to 31*d*) includes a control apparatus 100 including a processor and a memory, and a start button 101 that starts an image forming process of the image forming apparatus 20, an environment sensor 102 that detects environment conditions around the image forming unit 31, such as temperature and humidity conditions, for example, a concentration sensor 103 that detects a concentration of an evaluation image formed on the intermediate transfer body 45, and further, a counting sensor 104 or the like that counts a rotation speed (number of cycles) of the photoconductor 32 are connected to the control apparatus 100, as input destinations for collecting various information. In addition, a drive motor 110 of the photoconductor 32, a charging power supply 111 that applies a charging voltage $V_C$ to the charger 33, a light amount adjuster 112 that adjusts the exposure amount of the exposure device 34, a drive motor 113 that drives the developing roll 35*b* of the developing device 35 and a developing power supply 114 that applies a developing voltage $V_D$ to the developing roll 35*b*, a transfer power supply 115 that applies a transfer voltage $V_T$ to the transfer device 46, and the like are connected to the control apparatus 100, as output destinations for sending out a control signal. In the embodiments above, the term "processor" refers to hardware in a broad sense. Examples of the processor include general processors (e.g., CPU: Central Processing Unit) and dedicated processors (e.g., GPU: Graphics Processing Unit, ASIC: Application Specific Integrated Circuit, FPGA: Field Programmable Gate Array, and programmable logic device).

In the embodiments above, the term "processor" is broad enough to encompass one processor or plural processors in collaboration that are located physically apart from each other but may work cooperatively. The order of operations of the processor is not limited to one described in the embodiments above, and may be changed.

In the present example, the control apparatus 100 receives input signals from various input destinations, causes the processor to execute various control programs (including a cycle down start program, which will be described below) installed in the memory in advance, and sends out a predetermined control signal to each output destination.

Characteristic of Photoconductor Having Surface Protection Layer

Figure 4A:
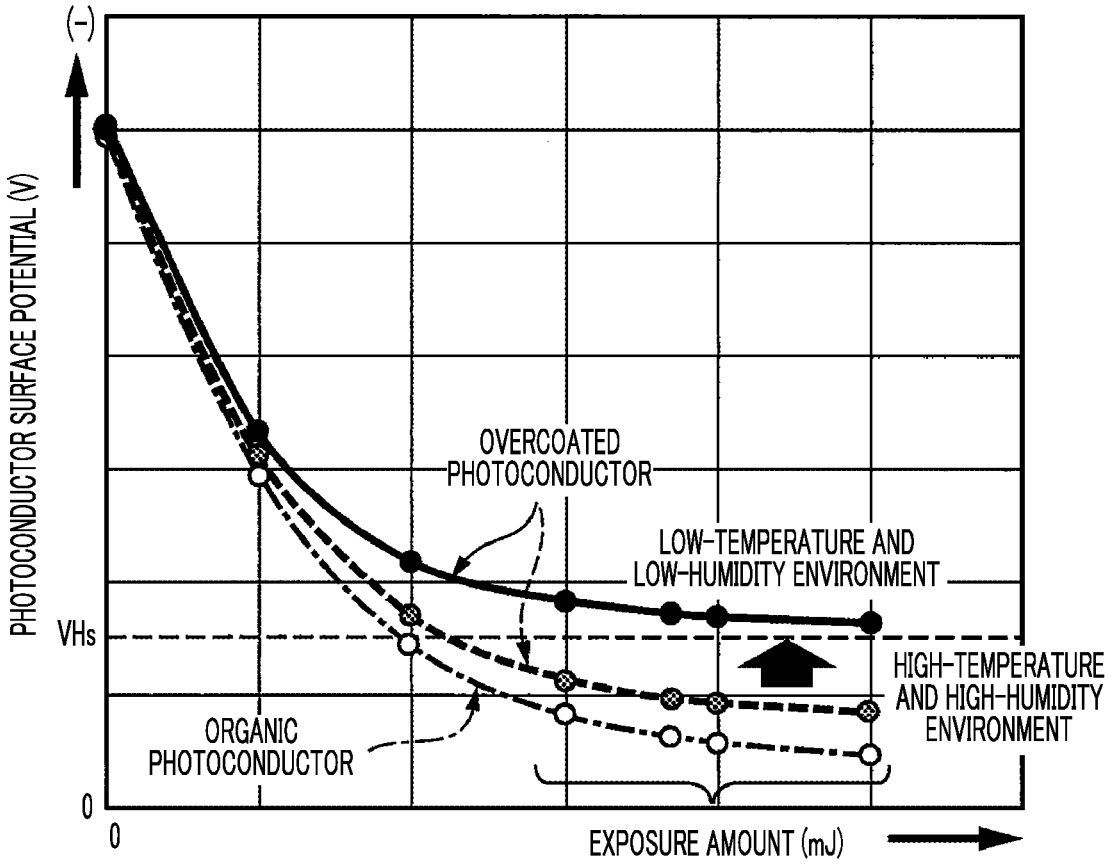
FIG. 4A is an explanatory diagram illustrating characteristics for exposure static elimination of a photoconductor having a surface protection layer and an organic photoconductor not having the surface protection layer.
Figure 4B:
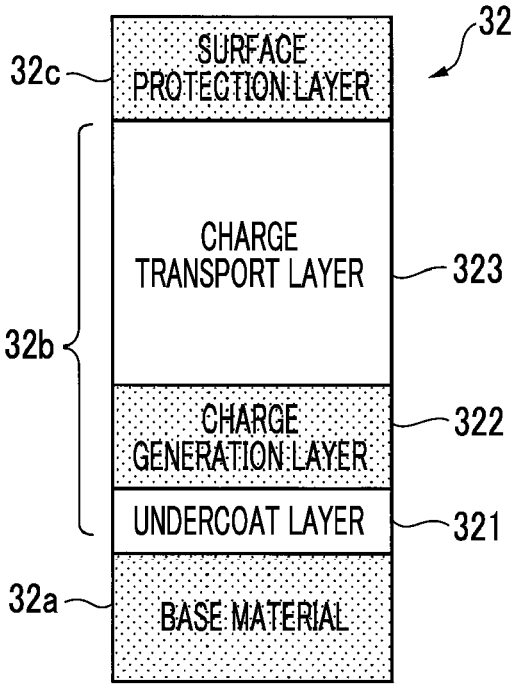
FIG. 4B is an explanatory diagram illustrating a surface structure of the photoconductor having the surface protection layer.

In the present exemplary embodiment, as illustrated in FIG. 4B, the photoconductor 32 has an organic photosensitive layer 32*b* stacked on a metal (aluminum in the present example) base material 32*a*, and a surface protection layer 32*c* having an excellent abrasion resistance stacked on the organic photosensitive layer 32*b*.

Here, the organic photosensitive layer 32*b* is formed by sequentially stacking an undercoat layer 321, a charge generation layer 322, and a charge transport layer 323 on the base material 32*a*, and the undercoat layer 321 blocks injection of a counter charge (+) generated by charging, and the charge generation layer 322 generates a charge (+−) by photoelectric conversion. Further, the charge transport layer 323 transports the charge (+) generated in the charge generation layer 322 to the surface protection layer 32*c*. Further, the surface protection layer 32*c* may be formed of a high-hardness material so as to prevent abrasion of the organic photosensitive layer 32*b*.

In the photoconductor (corresponding to a so-called overcoated photoconductor) 32 having such a surface protection layer 32*c*, as compared with an organic photoconductor without the surface protection layer 32*c*, charges are accumulated in the surface protection layer 32*c* or at an interface with the charge transport layer 323, so that in an exposure static elimination method using exposure by the exposure device 34 (details will be described below), a residual charge on the photoconductor 32 may not be removed.

Regarding this point, as illustrated in FIG. 4A, an experiment in which a residual potential is plotted by changing an exposure amount of exposure static elimination is performed on a photoconductor having the surface protection layer 32*c* (denoted as an overcoated photoconductor in FIG. 4A) and a photoconductor without the surface protection layer (denoted as an organic photoconductor in FIG. 4A). By increasing the exposure amount of the organic photoconductor, the residual potential on the photoconductor 32 after static elimination can be further reduced from a predetermined allowable static elimination level VHs. On the other hand, in the overcoated photoconductor, a current potential on the photoconductor 32 is reduced below the allowable static elimination level VHs by increasing the exposure amount of the exposure static elimination method under a predetermined high-temperature and high-humidity environment, and in a predetermined low-temperature and low-humidity environment, it is difficult to reduce the residual potential on the photoconductor 32 to be less than the allowable static elimination level even in a case where the exposure amount is increased by the exposure static elimination method.

In the present exemplary embodiment, since the negative electrode photoconductor 32 is used, the photoconductor 32 is charged in a −direction, and eliminated in a +direction. In this case, the term "reduction" as used herein means that the potential changes in a direction approaching 0 V from the charged polarity.

In FIG. 4A, it is understood that the exposure static elimination method may not function effectively depending on the environment conditions.

In the overcoated photoconductor, not only under environment conditions, for example, but also in a case where the charge amount of toner increases due to continuous running of a low-density image, or in a case where the amount of charge generated by the photoconductor 32 changes due to changes over time, a situation in which the residual potential on the photoconductor 32 cannot be sufficiently reduced may occur.

Therefore, in the present exemplary embodiment, in a case where a cycle down start process of removing the residual charge of the photoconductor 32 is executed after the image formation process is completed, the exposure static elimination method is executed for a situation in which the residual charge on the photoconductor 32 can be removed by the exposure static elimination method, and a transfer static elimination method (details will be described below) using the transfer device 46 different from the exposure static elimination method is executed in a situation in which the residual charge on the photoconductor 32 cannot be removed by the exposure static elimination method.

The term "cycle down" as used herein refers to a cycle in which an operation of the image forming apparatus, that is in a normal image forming cycle, is stopped.

Cycle Down Start Process

Figure 5:
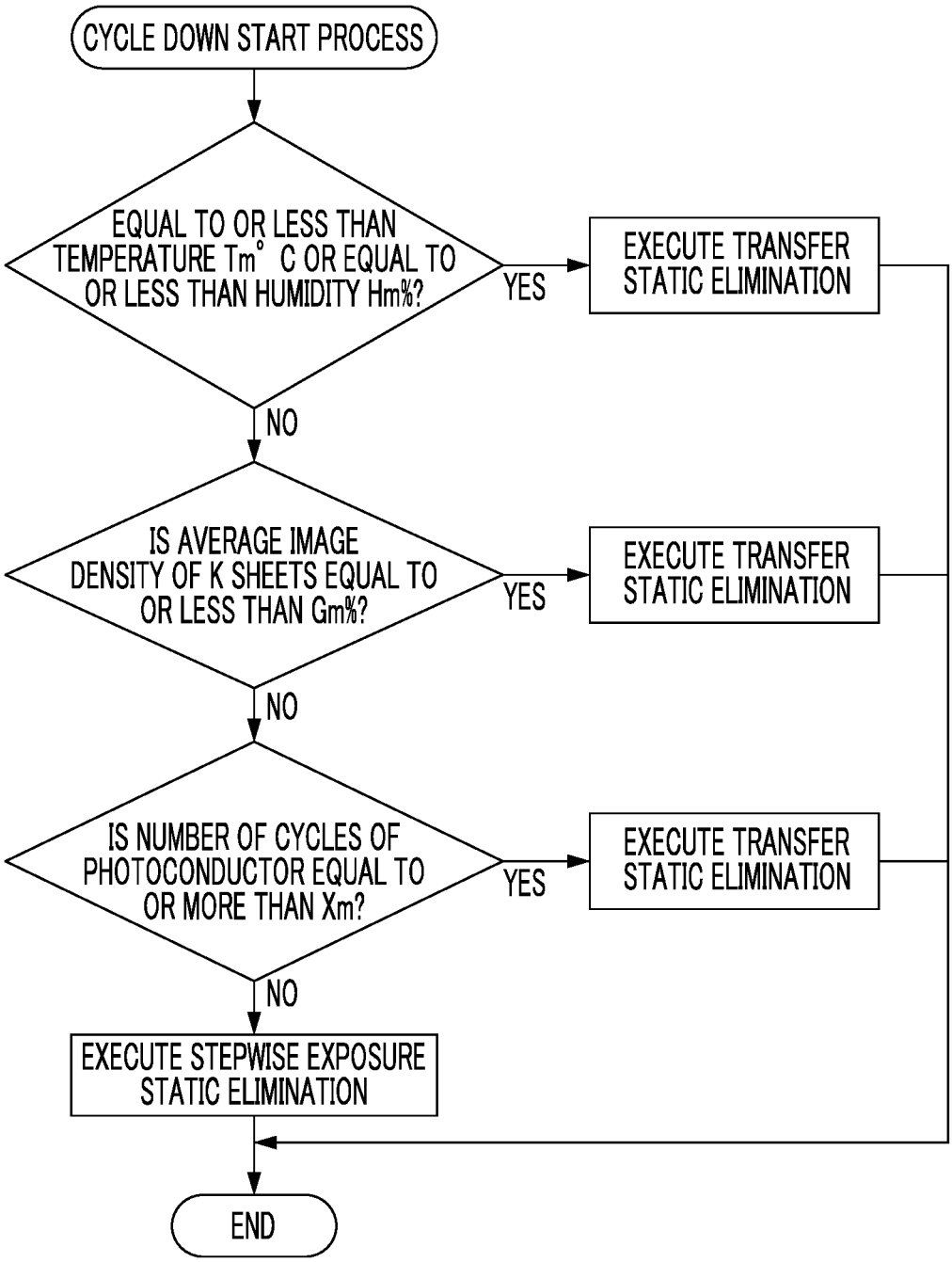
FIG. 5 is an explanatory diagram illustrating a flowchart at a start of cycle down of the image forming apparatus according to the present exemplary embodiment.
Figure 6:
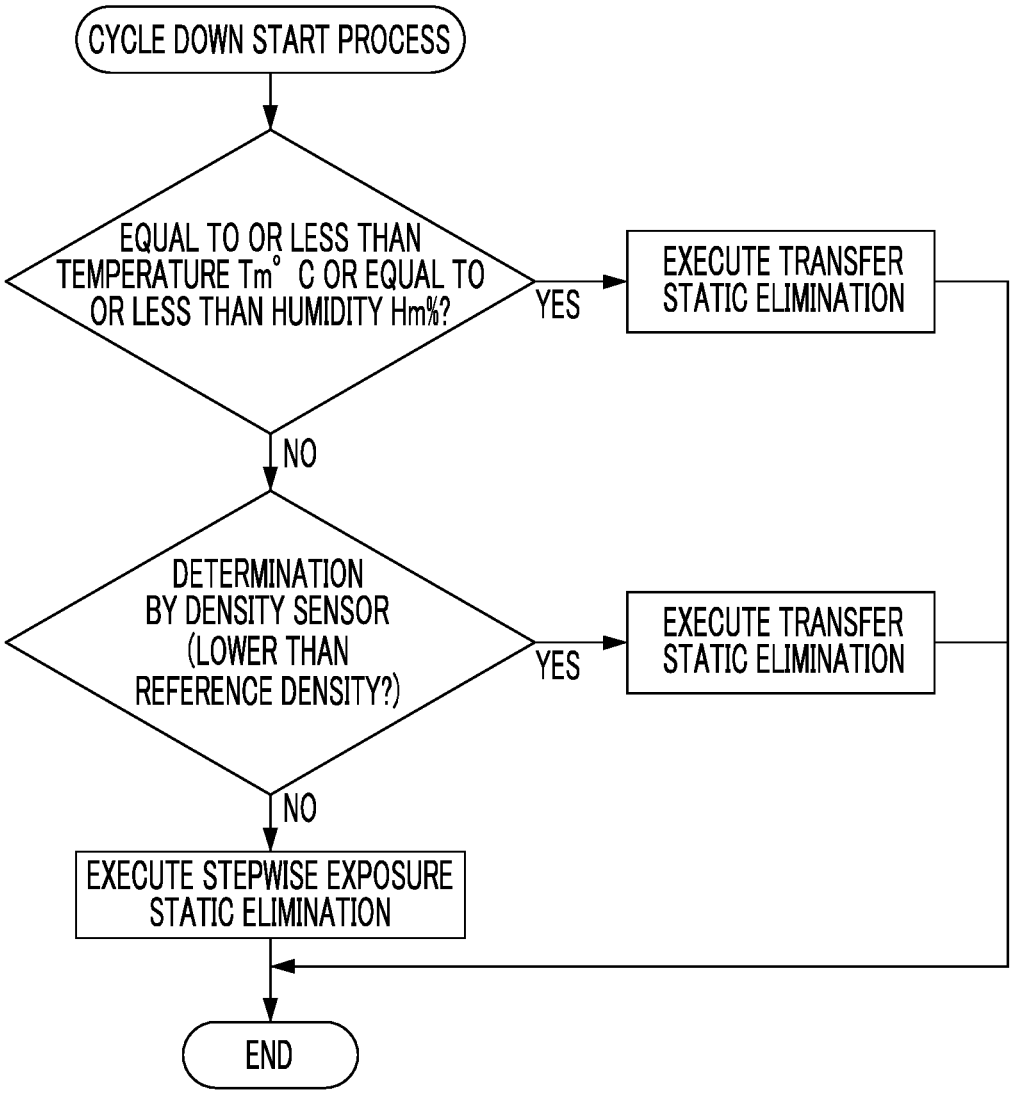
FIG. 6 is an explanatory diagram illustrating another flowchart at the start of cycle down of the image forming apparatus according to the present exemplary embodiment.

In the present example, the control apparatus 100 executes, for example, a cycle down start process illustrated in FIG. 5 or FIG. 6.

Cycle Down Start Process I

The cycle down start process illustrated in FIG. 5 is obtained by switching the exposure static elimination method ("staircase exposure static elimination" in the present example) and the transfer static elimination method, as a method of discriminating environment conditions, average image density conditions, and photoconductor cycle number conditions, and eliminating a residual potential from the photoconductor 32.

First, as a discrimination process of the environment condition, it is determined whether or not an environment condition is a low-temperature and low-humidity condition, from detection information of the environment sensor 102, and in a case of the low-temperature and low-humidity environment, the "transfer static elimination method" is executed.

Here, in the present example, the low-temperature and low-humidity environment has a condition in which a temperature is equal to or less than a predetermined Tm (for example, 15° C.) and humidity is equal to or less than predetermined Hm (for example, 30%).

Further, as a discrimination process of the average image density condition, the image discrimination unit (a functional unit that calculates the average image density from image data to be image-formed) in the control apparatus 100 determines whether or not the average image density of running of predetermined k sheets (for example, 100 sheets) is equal to or less than a threshold value Gm (for example, 1%), and in a case where the average image density is equal to or less than Gm, the "transfer static elimination method" is executed.

Figure 8A:
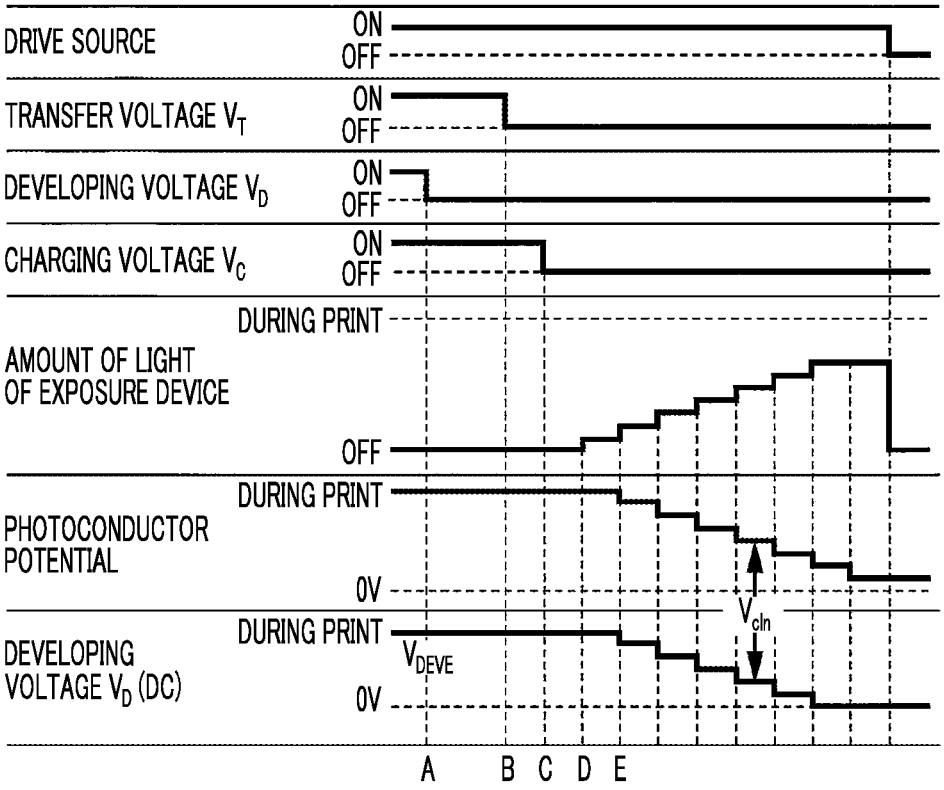
FIG. 8A is a timing chart illustrating an operation process of each device during an exposure static elimination process.
Figure 8B:
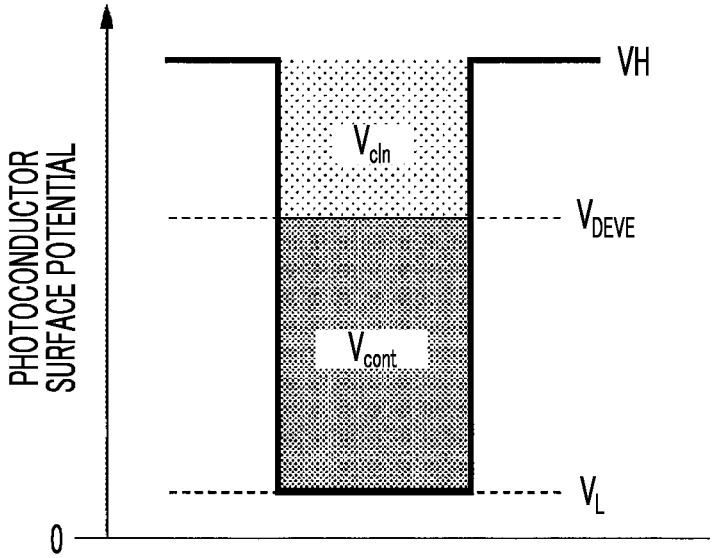
FIG. 8B is an explanatory diagram schematically illustrating a development operation during an image forming process.

The present example is based on the fact that since the amount of charge of the toner increases due to the continuous running of the low-density image, it is necessary to increase a required image potential (difference between developing voltage $V_D$ and image portion potential $V_L$; see FIG. 8B) as compared with a case where the amount of charge of the toner does not increase, and in a case where the residual potential is high, the required image potential and a non-image portion potential VH are high, so that static elimination cannot be performed only by exposure static elimination.

Further, as a discrimination process of the number of photoconductor cycles, it is determined whether or not the number of photoconductor cycles is equal to or more than a predetermined threshold value Xm based on information of the counting sensor 104 that counts the number of cycles of the photoconductor 32. In a case where the number of photoconductor cycles is equal to or more than Xm, it is presumed that the amount of charge generated by the photoconductor is changed due to a repeated stress of exposure over time and the residual potential of the photoconductor is increased, and the "transfer static elimination method" is executed.

Cycle Down Start Process II

The cycle down start process illustrated in FIG. 6 is obtained by switching the exposure static elimination method ("staircase exposure static elimination" in the present example) and the transfer static elimination method, as a method of discriminating environment conditions, and image concentration conditions, and eliminating a residual potential from the photoconductor 32.

In the present example, a discrimination process of the environment condition has the same manner as the cycle down start process I illustrated in FIG. 5.

Further, as a discrimination process of the image concentration condition, it is determined whether or not the image concentration is lower than the reference concentration based on concentration information of an image for concentration evaluation detected by the concentration sensor 103 illustrated in FIG. 3, the "transfer static elimination method" is executed.

The present example is based on the fact that in a case where the image concentration does not reach a predetermined reference concentration, it is necessary to increase the required image potential (difference between developing voltage $V_D$ and image portion potential $V_L$; see FIG. 8B) as compared with a case where the amount of charge of the toner does not increase, and in a case where the residual potential is high, the required image potential and a non-image portion potential VH are high, so that static elimination cannot be performed only by exposure static elimination.

Exposure Static Elimination Method

Figure 7:
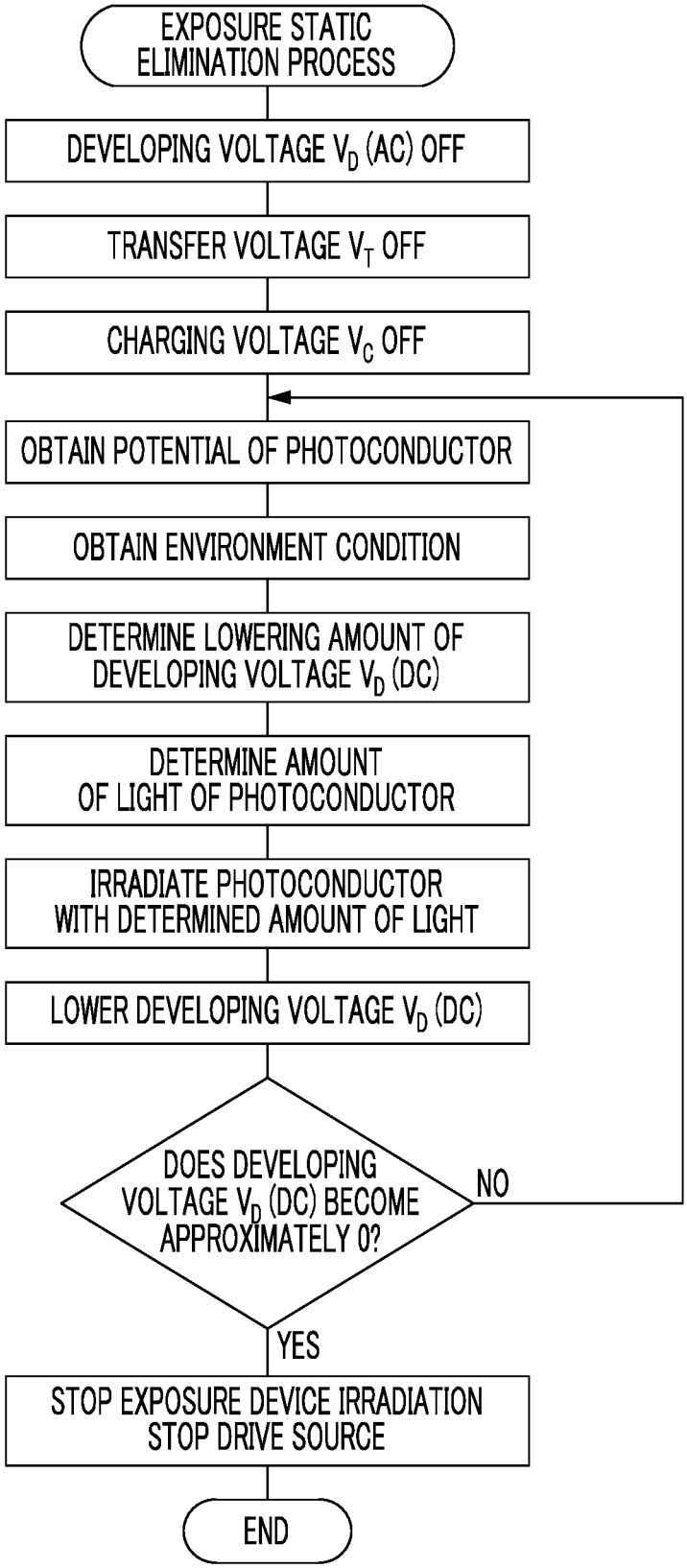
FIG. 7 is an explanatory diagram illustrating a flowchart for executing an exposure static elimination process.

FIG. 7 is a flowchart of an exposure static elimination process executed in the present exemplary embodiment, and FIG. 8A is a timing chart illustrating an operation timing of each unit during the exposure static elimination process.

In FIGS. 3, 7, and 8A, in a case where the exposure static elimination process is started, first, the control apparatus 100 turns off the developing voltage $V_D$ (AC) of the developing device 35, the transfer voltage $V_T$ of the transfer device 46, and the charging voltage $V_C$ of the charger 33.

After that, the control apparatus 100 acquires a potential of the photoconductor 32 from a potential sensor (not illustrated), and also acquires temperature and humidity information from the environment sensor 102.

After that, the control apparatus 100 raises a potential of the developing power supply 114, and lowers the developing voltage $V_D$ (DC). Since the developing roll 35*b* is charged with a negative potential, the potential actually rises toward 0. Meanwhile, since the negative potential side is the upper part in FIG. 8A, the developing voltage $V_D$ (DC) is illustrated so as to decrease linearly in the lower part in FIG. 8A. At this time, a time at which the lowering is started is illustrated as E in FIG. 8A. The E is a time in a case where a location at which static elimination of the photoconductor 32 by the exposure device 34 is started reaches a position of the developing roll 35*b*. That is, since the photoconductor 32 is rotated by the drive motor 110, this location moves to the position of the developing roll 35*b* in a time of E to D. Starting from this location, the lowering of the potential applied to the developing roll 35*b* is started.

Further, in the present exemplary embodiment, a difference ($V_{cln}$) between a potential on the surface of the photoconductor 32 and the potential (developing voltage $V_D$ (DC)) applied to the developing roll 35*b* at this time is set within a predetermined range.

Here, as illustrated in FIG. 8B, a surface potential distribution of the photoconductor 32 at the time of image formation is schematically illustrated, and assuming that a non-image portion potential is VH (for example, −600 V), an image portion potential is $V_L$ (for example, −50 V), a developing voltage VD (DC) is $V_{DEVE}$, a difference between VH and $V_{DEVE}$ is $V_{cln}$, and a difference between $V_{DEVE}$ and $V_L$ is $V_{cont}$, in a case where $V_{cont}$ is small, a concentration becomes insufficient, and $V_{cln}$ controls toner fog or carrier discharge to the non-image portion potential VH.

As a result, the difference between the potential on the surface of the photoconductor 32 and the potential on the developing roll 35*b* is within the predetermined range. A range of $V_{cln}$ varies depending on the environment conditions, and is, for example, 100±30 V. In a case where $V_{cln}$ is out of this range, discharge of the toner or carrier is likely to occur. That is, in a case where $V_{cln}$ is too small, the toner is likely to move to the photoconductor 32 side. Further, in a case where $V_{cln}$ is too large, the carrier is likely to move to the photoconductor 32 side. In the present exemplary embodiment, the discharge of the toner or carrier is suppressed by setting $V_{cln}$ within a predetermined range.

Further, in the present example, as illustrated in FIGS. 7 and 8A, the amount of light of the exposure device (LED writing head in the present example) 34 is gradually increased. As a result, the potential on the surface of the photoconductor 32 and the developing voltage $V_D$ (DC) are both lowered. A difference ($V_{cln}$) between the potential on the surface of the photoconductor 32 and the developing voltage $V_D$ (DC) can be set within the predetermined range. In FIG. 8A, a state in which the amount of light of the exposure device 34 is gradually increased and the potential on the surface of the photoconductor 32 is gradually lowered to approach the ground potential is illustrated in a stepwise manner.

As illustrated in FIG. 7, in a case where the developing voltage $V_D$ (DC) becomes approximately 0, the control apparatus 100 stops the exposure of the photoconductor 32 by the exposure device 34, and turns the control signal for the drive motors 110 and 113 from ON to OFF. As a result, the exposure device 34 is turned off, the drive motors 110 and 113 are stopped, and both the photoconductor 32 and the developing roll 35*b* are stopped. In FIG. 8A, this time is illustrated as F. At this point F, the stop operation for stopping the formation of the image is completed.

Transfer Static Elimination Method

Figure 9A:
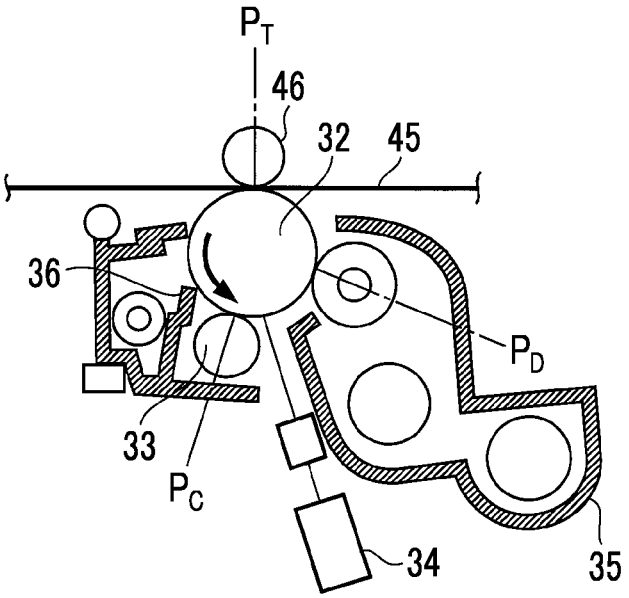
FIG. 9A is an explanatory diagram illustrating a device group for executing a transfer static elimination process.

FIG. 9A schematically illustrates a device group of executing a transfer static elimination process, in which a charging position by the charger 33 is indicated by PC, a developing position by the developing device 35 is indicated by PD, and a transfer position by the transfer device 46 is indicated by PT.

Figure 9B:
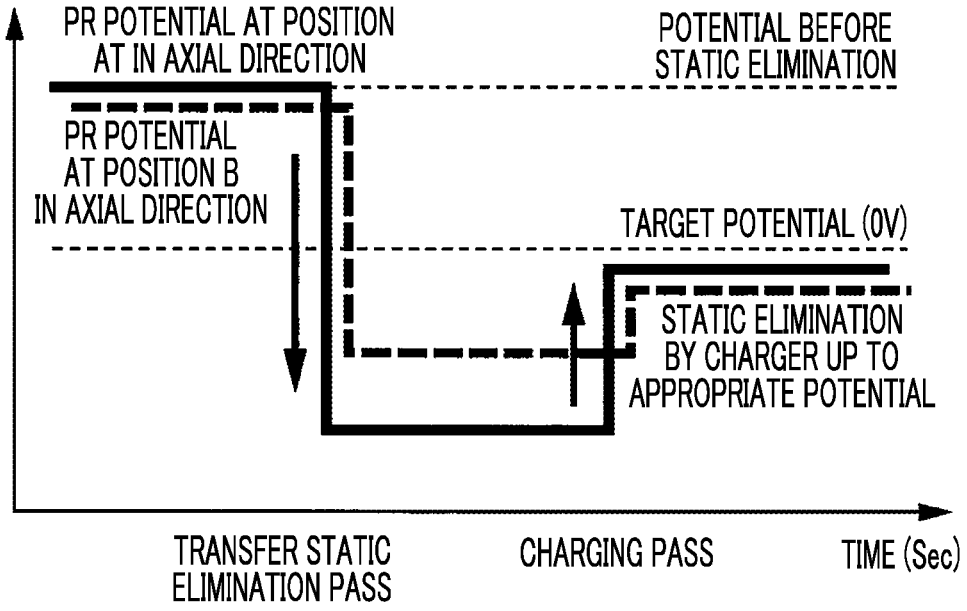
FIG. 9B is an explanatory diagram schematically illustrating a principle of the transfer static elimination process.

Further, FIG. 9B is an explanatory diagram schematically illustrating a principle of a transfer static elimination process.

FIG. 9B illustrates a change in a charging potential of the photoconductor 32 by static elimination. Here, a static elimination voltage is applied so that a static elimination current, that is a current larger than a transfer current that flows by applying the transfer voltage $V_T$ in a case where a toner image is transferred to the transfer device 46. The transfer power supply 115 illustrated in FIG. 3 is a power supply having a large current capacity capable of passing a static elimination current having a level for lowering the photoconductor 32 having a potential before static elimination to a static over-elimination charging potential that exceeds a target potential. By passing the static elimination current, the photoconductor 32 is lowered to the static over-elimination charging potential exceeding the target potential. After lowering to the static over-elimination charging potential, this time, a static elimination charging voltage for returning the surface having the static over-elimination charging potential to the target potential at a time of static elimination is applied to the charger 33. As a result, the surface of the static over-elimination charging potential is returned to the target static elimination charging potential at the time of static elimination.

At a stage in which the charging potential of the photoconductor 32 transitions to the static over-elimination charging potential due to the action of the transfer device 46, the photoconductor 32 has a potential distribution in an axial direction, and by subsequent charging by the charger 33, the photoconductor 32 has an approximately uniform target potential.

FIG. 9B is a sequence assuming that a potential of the photoconductor 32 is shifted to a final target static elimination charging potential at once, while the photoconductor 32 makes one round. In a case where a charging capacity (static elimination capacity) of the photoconductor 32 by the transfer device 46 is sufficiently high, the sequence of transitioning at once as illustrated in FIG. 9B may be adopted. Meanwhile, in a case where the charging capacity (static elimination capacity) of the transfer device 46 is limited, that is, in a case where the transfer power supply 115 illustrated in FIG. 3 cannot afford to pass a current to the transfer device 46 to make a transition at once from the charging potential at the time of image formation to the static over-elimination charging potential that is very different from the charge potential, a sequence of rotating the photoconductor 32 a plurality of times and gradually perform static elimination for each rotation may be adopted.

Figure 10:
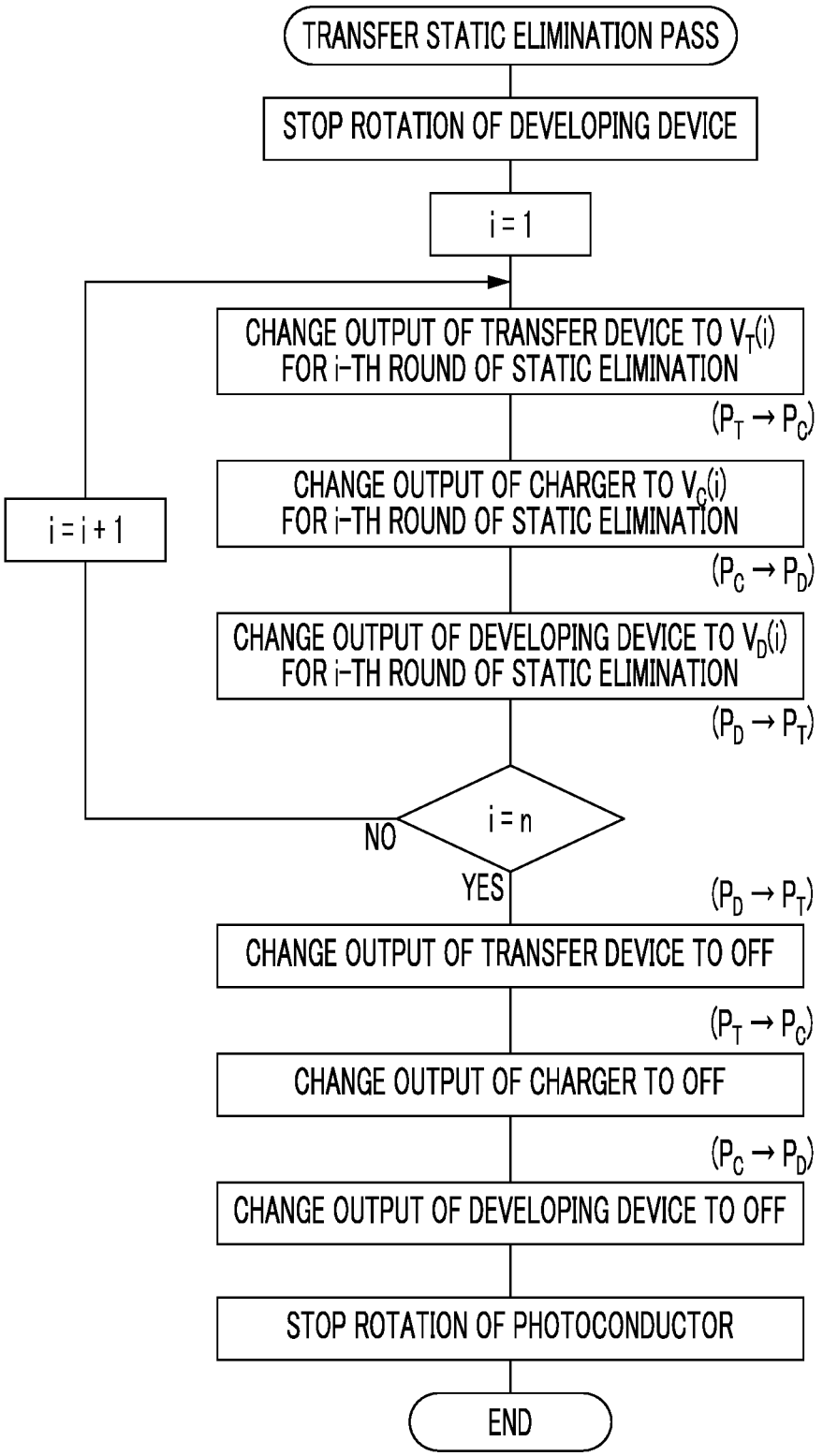
FIG. 10 is an explanatory diagram illustrating a flowchart for executing the transfer static elimination process.

FIG. 10 is a flowchart in which a transfer static elimination process is gradually executed while rotating the photoconductor 32 a plurality of times. In FIG. 10, n indicates the number of rotations of the photoconductor 32, and it is assumed that n=2, for example. Further, in the transfer static elimination process, a negative voltage [−V] is applied to the charger 33 and the developing device 35 and a positive voltage [+V] is applied to the transfer device 46 so that a current flows in a direction of canceling the negative charge of the photoconductor 32.

In FIG. 10, in a case where a cycle down is started, a rotation of the developing device 35 is first stopped, and then a rotation operation of a first round of the photoconductor 32 is performed.

At this time, the control apparatus 100 changes an output of the transfer device 46 to $V_T(1)$ for the first round of static elimination. Here, the output of the transfer device 46 is 20 A.

Next, in a case where the transfer position PT of the photoconductor 32 facing the transfer device 46 reaches the charger 33 at a timing at which the output of the transfer device 46 is changed to $V_T(1)$ for the first round of static elimination, as illustrates in FIG. 9A, in a case where the photoconductor 32 rotates by a predetermined angle, an output of the charger 33 is changed to $V_C(1)$ for the first round of static elimination. In the present example, the output of the charger 33 here is −900 V.

Further, in a case where the charging position PC of the photoconductor 32 facing the charger 33 reaches the developing device 35 at a timing at which the output of the charger 33 is changed to $V_C(1)$ for the first round of static elimination, as illustrated in FIG. 9A, an output of the developing device 35 is changed to $V_D(1)$ for the first round of static elimination. In the present example, the output of the developing device 35 here is −170 V.

Next, in a case where the developing position PD of the photoconductor 32 facing the developing device 35 reaches the transfer device 46 at a timing at which the output of the developing device 35 is changed to $V_D(1)$ for the first round of static elimination, that is, in a case where the photoconductor 32 makes one round from the start of cycle down, an output of the transfer device 46 is changed to $V_T(2)$ for a second round of static elimination. Meanwhile, in the present example, the same current value as $V_T(1)$ for the first round of static elimination is adopted as the output of the transfer device 46 for the second round of static elimination.

In a case where the transfer position PT of the photoconductor 32 facing the transfer device 46 reaches the charger 33 at a timing at which the output of the transfer device 46 is changed to $V_T(2)$ for the second round of static elimination, the output of the charger 33 is changed to $V_C(2)$ for the second round of static elimination, this time. In the present example, the output of the charger 33 here is −600 V. The photoconductor 32 is charged to a charging voltage of 0 V by the output of the charger 33 of −600 V.

Next, in a case where the charging position PC of the photoconductor 32 facing the charger 33 reaches the developing device 35 at a timing at which the output of the charger 33 is changed to $V_C(2)$ for the second round of static elimination, the output of the developing device 35 is changed to $V_D(2)$ for the second round of static elimination, this time. In the present example, the output of the developing device 35 here is 0 V.

Next, in a case where the developing position PD of the photoconductor 32 facing the developing device 35 reaches the transfer device 46 at a timing at which the developing device 35 output is changed to $V_D(2)$ for the second round of static elimination, that is, in a case where the photoconductor 32 makes two rounds from the start of cycle down, it is considered that the transfer static elimination process is completed, and the output of the transfer device 46 is changed to OFF (0 μA).

Next, in a case where the transfer position PT of the photoconductor 32 facing the transfer device 46 reaches the charger 33 at a timing at which the transfer device 46 output is changed to OFF, the output of the charger 33 is changed to OFF, this time.

Further, in a case where the charging position PC of the photoconductor 32 facing the charger 33 reaches the developing device 35 at a timing at which the output of the charger 33 is changed to OFF, the output of the developing device 35 is changed to OFF, this time. Here, in the present example, the output of the developing device 35 is previously 0 V in the second round of static elimination, and in consideration of the fact that the output of the developing device 35 in the second round of static elimination may be finely adjusted, here, a step of changing the output of the developing device 35 to OFF is provided.

In this manner, after changing the output of the transfer device 46, the output of the charger 33, and the output of the developing device 35 to OFF, the rotation of the photoconductor 32 is stopped.

In the cycle down sequence described above, the rotation of the developing device 35 is stopped immediately after the cycle down is started. The reason why the rotation of the developing device 35 is stopped is that toner fog or carrier transfer can be suppressed as compared with a case where the cycle down sequence is executed while the developing device 35 is rotating. Meanwhile, for the purpose of suppressing toner fog or carrier transfer, it is not necessary to stop the rotation of the developing device 35 immediately after the cycle down is started, and the rotation of the developing device 35 may be stopped as long as the developing position PD facing the developing device 35 of the photoconductor 32 is at the charging potential at the time of image formation.

By adopting the cycle down of the sequence as described above, it is possible to eliminate static up to the target potential of the photoconductor 32 while suppressing toner fog or carrier transfer. Further, in a case where a plurality of steps (two-step in the present example) static elimination illustrated here is adopted, the current flowing through the transfer device 46 is suppressed, as compared with a case where the photoconductor 32 is eliminated in one step up to the target potential at once, so that the transfer power supply 115 having a small current capacity can be adopted.

Meanwhile, in a case where there is a margin in the current capacity of the transfer power supply 115, static elimination may be performed at once up to the target potential of the photoconductor 32 in one step. In that case, for example, the first round of static elimination illustrated in FIG. 10 may be omitted, and the voltage may be changed to the voltage for the second round of static elimination at once, from the time of image formation.

Alternatively, in a case where the current capacity of the transfer power supply 115 is further smaller, static elimination may be dispersed in three or more steps to gradually perform the static elimination.

Here, the image forming apparatus using the intermediate transfer body 45 is described as an example, and for example, a monochrome image forming apparatus including only one image forming unit that does not adopt the intermediate transfer body 45 can also be applied to the exemplary embodiment of the present invention.

Comparative Exemplary Embodiment 1

In the present exemplary embodiment, both the exposure static elimination method and the transfer static elimination method are provided, and the method is switched to either of the exposure static elimination methods and the transfer static elimination method. Meanwhile, assuming a comparative exemplary embodiment in which the exposure static elimination method and the transfer static elimination method are always executed at the same time, since transfer static elimination is always involved, it is not possible effectively extend a life even in the photoconductor 32 having a surface protection layer.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

an image holding section that consists of a photoconductor having a surface protection layer;

a charging section that charges a surface of the image holding section with a direct current potential;

an exposure section that exposes the surface of the image holding section charged by the charging section to form an electrostatic latent image;

a developing section that develops the electrostatic latent image formed on the image holding section;

a transfer section that electrostatically transfers a visible image formed on the image holding section to a transfer medium;

an exposure static elimination section that eliminates a residual charge of the image holding section by using the exposure section when image formation on the image holding section is stopped;

a transfer static elimination section that eliminates the residual charge of the image holding section by using at least the transfer section when the image formation on the image holding section is stopped; and a switching section that causes the exposure static elimination section to perform static elimination under a condition that the residual charge of the image holding section does not exceed a threshold value of an allowable static elimination level at which the residual charge is eliminated by the exposure static elimination section, and causes the transfer static elimination section instead of the exposure static elimination section to perform static elimination under a condition that the residual charge exceeds the threshold value.

2. The image forming apparatus according to claim 1, wherein the developing section develops the electrostatic latent image by using a two-component developer including toner and a carrier as an image forming material.

3. The image forming apparatus according to claim 2, wherein the exposure static elimination section reduces a developing voltage applied to the developing section to a ground potential, and causes the exposure section to execute static elimination.

4. The image forming apparatus according to claim 2, wherein the switching section includes a use condition recognition section capable of recognizing a use condition of the image holding section, and causes the exposure static elimination section or the transfer static elimination section to perform static elimination based on a recognition result by the use condition recognition section.

5. The image forming apparatus according to claim 3, wherein the exposure static elimination section gradually outputs an amount of light of the exposure section so that a residual potential of the image holding section gradually approaches the ground potential while the developing voltage applied to the developing section approaches a ground voltage.

6. The image forming apparatus according to claim 3, wherein the switching section includes a use condition recognition section capable of recognizing a use condition of the image holding section, and causes the exposure static elimination section or the transfer static elimination section to perform static elimination based on a recognition result by the use condition recognition section.

7. The image forming apparatus according to claim 5, wherein the switching section includes a use condition recognition section capable of recognizing a use condition of the image holding section, and causes the exposure static elimination section or the transfer static elimination section to perform static elimination based on a recognition result by the use condition recognition section.

8. The image forming apparatus according to claim 1, wherein the exposure static elimination section reduces a developing voltage applied to the developing section to a ground potential, and causes the exposure section to execute static elimination.

9. The image forming apparatus according to claim 8, wherein the exposure static elimination section gradually outputs an amount of light of the exposure section so that a residual potential of the image holding section gradually approaches the ground potential while the developing voltage applied to the developing section approaches a ground voltage.

10. The image forming apparatus according to claim 8, wherein the switching section includes a use condition recognition section capable of recognizing a use condition of the image holding section, and causes the exposure static elimination section or the transfer static elimination section to perform static elimination based on a recognition result by the use condition recognition section.

11. The image forming apparatus according to claim 9, wherein the switching section includes a use condition recognition section capable of recognizing a use condition of the image holding section, and causes the exposure static elimination section or the transfer static elimination section to perform static elimination based on a recognition result by the use condition recognition section.

12. The image forming apparatus according to claim 1, wherein the transfer static elimination section applies a static elimination voltage to the transfer section, and performs static elimination on the image holding section so that a surface potential of the image holding section becomes a target potential after static elimination.

13. The image forming apparatus according to claim 12, wherein the transfer static elimination section applies a static elimination voltage to the transfer section, and performs static elimination on the image holding section so that the surface potential of the image holding section exceeds the target potential after static elimination, and then causes the charging section to charge the image holding section so that the surface potential of the image holding section becomes the target potential after static elimination.

14. The image forming apparatus according to claim 12, wherein the switching section includes a use condition recognition section capable of recognizing a use condition of the image holding section, and causes the exposure static elimination section or the transfer static elimination section to perform static elimination based on a recognition result by the use condition recognition section.

15. The image forming apparatus according to claim 13, wherein the switching section includes a use condition recognition section capable of recognizing a use condition of the image holding section, and causes the exposure static elimination section or the transfer static elimination section to perform static elimination based on a recognition result by the use condition recognition section.

16. The image forming apparatus according to claim 1, wherein the switching section includes a use condition recognition section capable of recognizing a use condition of the image holding section, and causes the exposure static elimination section or the transfer static elimination section to perform static elimination based on a recognition result by the use condition recognition section.

17. The image forming apparatus according to claim 16, wherein the switching section includes an environment detection section capable of detecting environment information including a temperature and humidity around the image holding section as the use condition recognition section, and causes the transfer static elimination section when a detection result of the environment detection section belongs to a predetermined low-temperature and low-humidity environment, to perform static elimination.

18. The image forming apparatus according to claim 16, wherein the switching section includes a concentration detection section capable of detecting a concentration of a visible image formed on the image holding section as the use condition recognition section, and causes the transfer static elimination section to perform static elimination when concentration information detected by the concentration detection section is lower than a predetermined reference concentration.

19. The image forming apparatus according to claim 16, wherein the switching section includes an image discrimination unit capable of discriminating an average image density of a visible image formed in the image holding section as the use condition recognition section, and causes the transfer static elimination section to perform static elimination when the average image density discriminated by the image discrimination unit is lower than a predetermined reference image density in the number of continuous image formations.

20. The image forming apparatus according to claim 16, wherein the switching section includes a counting unit capable of counting a rotation speed of the image holding section as the use condition recognition section, and causes the transfer static elimination section to perform static elimination when the rotation speed of the image holding section counted by the counting unit is equal to or more than a predetermined reference rotation speed.

* * * * *